US007651992B2

(12) United States Patent
Culeron et al.

(10) Patent No.: US 7,651,992 B2
(45) **Date of Patent: *Jan. 26, 2010**

(54) FOAM-GENERATING KIT CONTAINING A FOAM-GENERATING DISPENSER AND A COMPOSITION CONTAINING A HIGH LEVEL OF SURFACTANT

(75) Inventors: Guy Hubert Stephane Sylvain Culeron, Rhode Saint Genese (BE); Howard David Hutton, III, Cincinnati, OH (US); Raphael Louis Mangin, Brussels (BE); Akiko Taneko, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 578 days.

This patent is subject to a terminal disclaimer.

(21) Appl. No.: 10/787,343

(22) Filed: Feb. 26, 2004

(65) Prior Publication Data

US 2004/0229963 A1 Nov. 18, 2004

Related U.S. Application Data

(60) Provisional application No. 60/502,673, filed on Sep. 12, 2003, provisional application No. 60/502,668, filed on Sep. 12, 2003, provisional application No. 60/472,954, filed on May 23, 2003, provisional application No. 60/451,063, filed on Feb. 28, 2003.

(51) Int. Cl.
*C11D 17/04* (2006.01)

(52) U.S. Cl. ..... 510/218; 510/219; 510/235; 510/406

(58) Field of Classification Search ..... 510/406, 510/120, 220, 218, 219, 235; 8/405; 424/400
See application file for complete search history.

(56) References Cited

U.S. PATENT DOCUMENTS

| | | | | | |
|---|---|---|---|---|---|
| 3,422,993 | A | * | 1/1969 | Boehm et al. | 222/190 |
| 3,709,437 | A | * | 1/1973 | Wright | 239/343 |
| 3,728,265 | A | * | 4/1973 | Schmitt et al. | 510/406 |
| 3,962,150 | A | | 6/1976 | Viola | |
| 4,193,513 | A | * | 3/1980 | Bull, Jr. | 222/1 |
| 4,511,488 | A | | 4/1985 | Matta | |
| 4,646,973 | A | * | 3/1987 | Focaracci | 239/428.5 |
| 4,911,361 | A | * | 3/1990 | Tada | 239/1 |
| 5,075,026 | A | * | 12/1991 | Loth et al. | 510/101 |
| 5,076,954 | A | | 12/1991 | Loth et al. | |
| 5,082,584 | A | | 1/1992 | Loth et al. | |
| 5,108,643 | A | | 4/1992 | Loth et al. | |
| 5,393,468 | A | | 2/1995 | Erilli et al. | |
| 5,431,345 | A | * | 7/1995 | Lund et al. | 239/329 |
| 5,443,569 | A | * | 8/1995 | Uehira et al. | 222/190 |
| 5,580,848 | A | | 12/1996 | Drapier | |
| 5,602,091 | A | * | 2/1997 | Monson et al. | 510/406 |
| 5,616,548 | A | | 4/1997 | Thomas et al. | |
| 5,635,469 | A | * | 6/1997 | Fowler et al. | 510/406 |
| 5,663,136 | A | * | 9/1997 | Van Dijk et al. | 510/444 |
| 5,679,630 | A | * | 10/1997 | Baeck et al. | 510/305 |
| 5,780,415 | A | | 7/1998 | Leonard et al. | |
| 5,804,546 | A | * | 9/1998 | Hall | 510/406 |
| 5,854,187 | A | | 12/1998 | Blum et al. | |
| 5,858,954 | A | * | 1/1999 | Balzer | 510/417 |
| 5,861,367 | A | | 1/1999 | Blanvalet et al. | |
| 5,912,223 | A | | 6/1999 | Drapier | |
| 5,925,608 | A | | 7/1999 | Spruyt | |
| 5,929,023 | A | | 7/1999 | Durbut et al. | |
| 5,981,449 | A | * | 11/1999 | Rapisarda et al. | 510/108 |
| 6,114,298 | A | * | 9/2000 | Petri et al. | 510/372 |
| 6,121,228 | A | | 9/2000 | Drapier et al. | |
| 6,147,047 | A | | 11/2000 | Robbins et al. | |
| 6,440,912 | B2 | * | 8/2002 | McGee et al. | 510/140 |
| 6,536,685 | B2 | * | 3/2003 | Bennett | 239/343 |
| 6,612,468 | B2 | * | 9/2003 | Pritchett et al. | 222/190 |
| 6,835,018 | B2 | * | 12/2004 | Miczewski et al. | 401/196 |
| 7,402,554 | B2 | * | 7/2008 | Goldman et al. | 510/406 |
| 2004/0254253 | A1 | | 12/2004 | Culeron et al. | |

FOREIGN PATENT DOCUMENTS

| | | |
|---|---|---|
| DE | 100 07 321 A1 | 8/2001 |
| EP | 0 966 950 A2 | 12/1999 |
| WO | WO 91/14759 | 10/1991 |
| WO | WO 96/01305 A1 | 1/1996 |
| WO | WO 97/25401 A1 | 7/1997 |

(Continued)

OTHER PUBLICATIONS

U.S. Appl. No. 10,788,123, filed Feb. 26, 2004, Ford et al.

(Continued)

*Primary Examiner*—Lorna M Douyon
(74) *Attorney, Agent, or Firm*—Idris N. McKelvey; Laura R. Grunzinger; Kim W. Zerby

(57) ABSTRACT

A foam-generating kit contains a non-aerosol container with a foam-generating dispenser and a high surfactant composition, preferably within the container. The high surfactant composition comprises, by weight of the high surfactant composition, at least 20% of a surfactant system. When the foam-generating dispenser is employed with the high surfactant composition, the foam-generating dispenser generates a foam having a foam to weight ratio of greater than about 2 mL/g.

13 Claims, 3 Drawing Sheets

FOREIGN PATENT DOCUMENTS

| | | | |
|---|---|---|---|
| WO | WO 99/58631 | A1 | 11/1999 |
| WO | WO 02/00820 | A1 | 1/2002 |
| WO | WO 02/17876 | A2 | 3/2002 |
| WO | WO 2004/016233 | A1 | 2/2004 |

OTHER PUBLICATIONS

U.S. Appl. No. 10/787,342, filed Feb. 26, 2004, Hutton, III et al.
U.S. Appl. No. 10/787,266, filed Feb. 26, 2004, Culeron et al.

* cited by examiner

FOAM-GENERATING KIT CONTAINING A FOAM-GENERATING DISPENSER AND A COMPOSITION CONTAINING A HIGH LEVEL OF SURFACTANT

CROSS REFERENCES TO RELATED APPLICATIONS

This application claims the benefit of the filing date of U.S. patent application Ser. No. 60/502,673, filed Sep. 12, 2003, and U.S. Patent Application No. 60/502,668, filed Sep. 12, 2003, which claims the benefit of the filing date of U.S. Patent Application No. 60/472,954, filed May 23, 2003, which claims the benefit of the filing date of U.S. Patent Application No. 60/451,063, filed Feb. 28, 2003, which are incorporated by reference herein.

FIELD OF THE INVENTION

The present invention relates to cleaning compositions and containers therefor. Specifically, the present invention relates to cleaning compositions containing high levels of surfactant and containers therefor. The present invention also generally relates to foam-generating dispensers.

BACKGROUND OF THE INVENTION

Compositions containing high levels of surfactant (high surfactant compositions), such as concentrated dish washing compositions, hand soap compositions, shampoo compositions, laundry compositions, scrubbing compositions, etc. are well known and have typically provided in a liquid, a gel or a paste. While liquids and pastes may be useful in a variety of situations, such physical forms are no longer considered new and exciting. Also, while it is desirable to provide new and interesting physical forms, the use of the above compositions has typically been limited to application or pre-application of such liquids, gels and pastes into a substrate, and then the additional step of direct application to the desired surface.

While it is known to employ a foam-generating dispenser to make low-surfactant level compositions foam (i.e., body washes containing>12% surfactant), this approach has not to date succeeded for high surfactant compositions, as there is typically a direct correlation between increased surfactant levels and increased viscosity. Specifically, the rheology of high surfactant compositions makes it difficult to achieve an acceptable foam without extremely turbulent and violent flow characteristics. As such turbulent flow characteristics often require excessive physical exertion or a highly-pressurized container, the practical result is that formulators are often required to lower the viscosity of their products so as to match the limitations of the foam-generating dispensers currently on the market. Therefore, this approach imparts an artificial, physical constraint upon formulators' freedom to achieve the best performing and/or lowest cost composition if foam-generation is desired.

Accordingly, the need exists for a foam-generating dispenser which is able to produce foam from a high surfactant composition. The need further exists for a foam-generating dispenser which may produce such a foam, without the need for excessive physical exertion, and/or the need to use an aerosol propellant.

SUMMARY OF THE INVENTION

The present invention relates to foam-generating kit containing a non-aerosol container with a foam-generating dispenser and a high surfactant composition, preferably within the container. The high surfactant composition contains, by weight of the high surfactant composition, at least about 20% of a surfactant system. When the foam-generating dispenser is employed with the high surfactant composition, the foam-generating dispenser generates a foam having a foam (i.e., volume) to weight ratio of greater than about 2 mL/g.

It has now been found that the combination of a foam-generating dispenser and a high surfactant composition can simultaneously provide acceptable foaming without excessive physical exertion and without employing an aerosol propellant. Without intending to be limited by theory, it is believed that when an increasingly turbulent flow path is produced, even a high surfactant composition can be made to produce an acceptable foam.

Furthermore, it is believed that a cleaning composition dispensed from a foam-generating dispenser according to the present invention may provide better and/or faster cleaning than the same composition dispensed in another manner. Without intending to be limited by theory it is believed that the physical foam generation forces the high surfactant composition to a state where it possesses an increased overall surface area. As most cleaning interactions such as speed and completeness of oil emulsification are directly related to the surface area covered, we believe that the form of the present invention can significantly improve overall cleaning. In addition, in the case of a microemulsion and/or a protomicroemulsion, it has surprisingly been found that by forcing the physical generation of foam, the present invention achieves the aesthetic benefit of physical foam, without chemically tying up the surfactant at the air-water interface. Instead, even though there is foam, a greater percentage of the surfactant is chemically available to bind to dirt, oils, etc., than if the foam was created by normal methods such as intermixing surfactant and water.

These and other features, aspects, advantages, and variations of the present invention, and the embodiments described herein, will become evident to those skilled in the art from a reading of the present disclosure with the appended claims, and are covered within the scope of these claims.

BRIEF DESCRIPTION OF THE FIGURES

While the specification concludes with claims particularly pointing out and distinctly claiming the invention, it is believed that the invention will be better understood from the following description of the accompanying figures in which like reference numerals identify like elements, and wherein:

Figure 1:
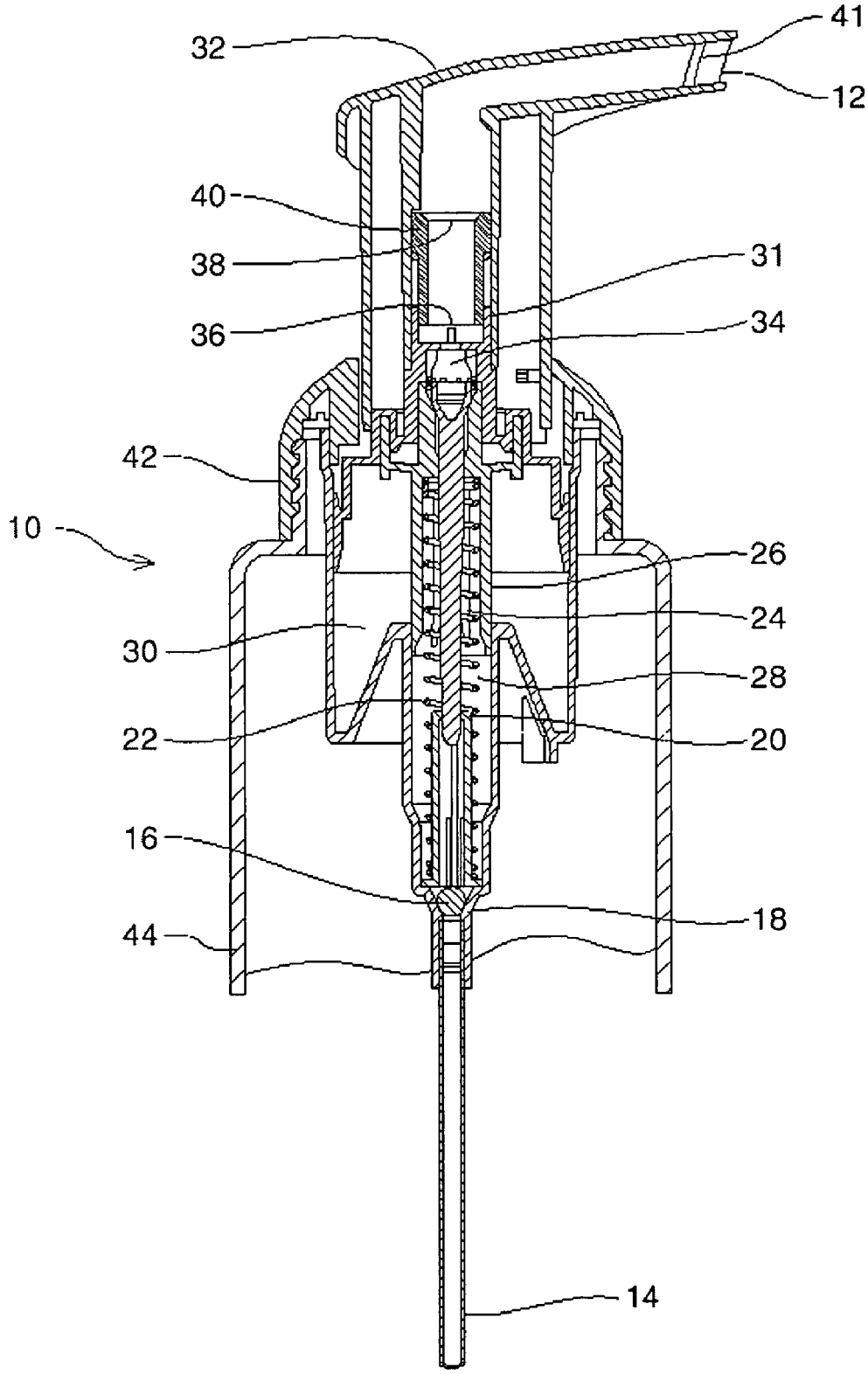
FIG. 1 is a cut-away view of a preferred embodiment of the foam-generating dispenser.

The figures herein are not necessarily drawn to scale.

DETAILED DESCRIPTION OF THE INVENTION

All percentages, ratios and proportions herein are by weight of the final high surfactant composition, unless otherwise specified. All temperatures are in degrees Celsius (° C.) unless otherwise specified.

As used herein, the term "comprising" means that other steps, ingredients, elements, etc. which do not affect the end result can be added. This term encompasses the terms "consisting of" and "consisting essentially of".

As used herein, the term "dish" means any dishware, tableware, cookware, glassware, cutlery, cutting board, food preparation equipment, etc. which is washed prior to or after contacting food, being used in a food preparation process and/or in the serving of food.

As used herein, the terms "foam" and "suds" are used interchangeably and indicate discrete bubbles of gas bounded by and suspended in a liquid phase.

As used herein, the term "microemulsion" means a oil-in-water emulsion which has the ability to emulsify oil into non-visible droplets. Such non-visible droplets typically have maximum diameter of less than about 100 angstroms (Å), preferably less than 50 Å as measured by methods known in the art, such as ISO 7027 which measures turbidity at a wavelength of 880 nm. Turbidity measuring equipment is easily available from, for example, Omega Engineering, Inc., Stamford, Conn., U.S.A.

As used herein, the term "protomicroemulsion" means a composition which may be diluted with water to form a microemulsion.

Container

The container useful herein is a non-aerosol container and typically has a hollow body for holding a high surfactant composition, preferably a dishwashing composition, and is most often a bottle or canister formed of plastic, glass, and/or metal, preferably a polymer or resin such as polyethylene, polypropylene, polyethylene terephthalate, polycarbonate, polystyrene, ethyl vinyl alcohol, polyvinyl alcohol, thermoplastic elastomer, and combinations thereof, although other materials known in the art may also be used. Such containers will typically hold from about 100 mL to about 2 L of liquid, preferably from about 150 mL to about 1.2 L of liquid, and more preferably from about 200 mL to about 1 L of liquid, and are well known for holding liquid consumer products. Such containers are widely available from many packaging suppliers.

Operatively attached to the container either directly or indirectly is a foam-generating dispenser for generating a foam. When activated, the foam-generating dispenser generates foam and concurrently dispenses the foamed composition from the container. The foam-generating dispenser may be formed as either integral with, or separate from the container. If formed separately, the foam-generating dispenser may attach to the container via methods known in the art such as by employing a transition piece, corresponding threaded male and female members, pressurized and non-pressurized seals, locking and snap-on parts, and/or other methods known in the art. Preferably, the foam-generating dispenser is attached to the container via a transition piece and/or with corresponding threaded male and female members which allow easy refilling.

The foam-generating dispenser may interact with the high surfactant composition via any method so as to generate a foam, such as a chemical reaction, an enzymatic reaction, and/or a mechanical action. However, a mechanical action is preferred herein, and typically involves a mechanism which imparts or mixes a gas, such as air, nitrogen, carbon dioxide, etc., directly into the dishwashing composition in a turbulent manner as it dispenses, so as to physically form the foam. Preferably, the foam-generating dispenser includes a gas imparting mechanism to form the foam from air via an air injection piston, foam-generating aperture, an impinging surface, a mesh or net, a pump, and/or a sprayer, more preferably, an air injection piston, a pump, an impinging surface, a plurality of meshes or nets, and/or a sprayer which injects or imparts air from the atmosphere into the dishwashing composition. In a highly preferred embodiment, the foam-generating dispenser employs at least three, preferably from three to five, meshes wherein the high surfactant composition flows through these meshes in series so as to generate the foam. Without intending to be limited by theory, it is believed that by flowing through the above meshes in series, the high surfactant composition is repeatedly turbulently mixed with air, thereby multiplying the foam-generating effect beyond that of any single mesh. As the percentage of surfactant system of the high surfactant composition increases, additional meshes may be added to provide the desired level of foaming and/or quality of foam.

The foam-generating dispenser also typically includes an activator, preferably a manual activator such as, for example, a trigger, a pressure-activated pumping mechanism, a button, and/or a slider, more preferably a button and/or a pressure-activated pumping mechanism which can be activated with a single finger. It is highly preferred that the activator be designed such that a consumer may easily activate it when their hands are wet and/or slippery, such as when in the middle of a manual dishwashing process. Such an activator should allow the user to easily and conveniently control both the speed of dispensing and the volume dispensed. For certain applications, such as in industry or in public facilities, other activators may be useful, such as an electronic activator, a computer-controlled activator, an electric eye or an infrared detection activator, a manual lever-assist activator, etc. The foam-generating dispenser useful herein generates a foam having a foam to weight ratio of greater than about 2 mL/g, more preferably from about 3 mL/g to about 10 mL/g, and even more preferably from about 4 mL/g to about 8 mL/g. Furthermore, the foam-generating dispenser useful herein generates at least about 2 mL foam, preferably from about 3 mL to about 10 mL, and more preferably from about 4 mL to about 8 mL, per mL of dishwashing composition. "Creamy" and "smooth" foams having fine bubbles dispersed relatively evenly throughout may be especially preferred for their aesthetic and/or performance characteristics. In certain cases, preferred foams are those which do not significantly degrade into liquid over a period of 3 minutes are especially preferred. Specifically, when the foam is dispensed onto a clean glass surface (e.g., a PYREX™ plate) and let sit for 3 minutes at 25° C., less than 1 mm of liquid should be apparent. Preferably, no liquid is visible at the edge of the foam after 3 minutes. However, in other cases, it has also been found that a certain amount of liquid (i.e., non-foam) is also preferable, as this liquid then permeates into the applicator (e.g., a sponge), and further extends the mileage of the high surfactant composition when it is used for, example, cleaning dishes.

FIG. 1 is a cut-away view of a preferred embodiment of the foam-generating dispenser, 10, with a nozzle, 12, from which the foamed dishwashing composition is dispensed. The dishwashing composition enters the foam-generating dispenser via a dip tube, 14, and flows past a ball, 16, and into a cylinder, 18. A plug, 20, prevents the ball, 16, from escaping, and also supports a coil spring, 22, and a inner rod, 24. A liquid piston, 26, creates a suction which draws the dishwashing composition past the ball, 16 and the plug, 20, into a liquid chamber, 28, and thereby primes the foam-generating dispenser, 10. Meanwhile, an air chamber, 30, and an air piston, 31 are also primed, and when the activator, 32, is depressed, both the air from the air chamber, 30, and the dishwashing composition from the liquid chamber, 28, are turbulently forced into the mixing chamber, 34, and past a first mesh, 36 and a second mesh, 38, which are both kept in place by a mesh holder, 40. As the turbulent air/dishwashing composition mixture is forced past the first mesh, 36, a first, rough foam is generated, which becomes more fine and even after passing through the second mesh, 38, and the third mesh, 41. These meshes may have the same, or different pore sizes. Also, additional meshes may also be employed, as desired.

In a preferred embodiment, the foam-generating dispenser contains a sponge therein or attached thereto, either in place of, or in addition to one or more meshes. A sponge also produces foam as the high surfactant composition is turbulently forced through its, open-celled structure. Such a sponge may be contained within the interior of the foam-generating dispenser and/or may also be located at the end of the nozzle, as desired. Without intending to be limited by theory, it has been found that additional meshes and/or a sponge located slightly within, and/or at the tip of the nozzle are especially useful herein, as they serve to generate the foam immediately prior to dispensing. Therefore, the user sees the desired foam as, or immediately after, it passes through the last turbulent flow area, while the foam quality is at its best and before it noticeably degrades and/or otherwise changes in quality.

FIG. 1 also shows a base cap, 42, which secures the foaming dispenser to a container, 44, which holds the high surfactant composition.

Preferred foam-generating dispensers useful herein include: T8900, OpAd FO, 8203, and 7512 series foamers from Afa-Polytek, Helmond, The Netherlands; T1, F2, and WR-F3 series foamers from Airspray International, Inc., Alkmaar, The Netherlands or North Pompano Beach, Fla., U.S.A.; TS-800 and Mixor series foamers from Saint-Gobain Calmar, Inc., City of Industry, Calif., U.S.A.; pump foamers and squeeze foamers from Daiwa Can Company, Tokyo, Japan; TS1 and TS2 series foamers from Guala Dispensing USA, Inc., Hillsborough, N.J., U.S.A.; and YT-87L-FP, YT-87L-FX, and YT-97 series foamers from Yoshino Kogyosho Co., Ltd., Tokyo, Japan. Also see the foam-generating dispensers discussed in the Japanese-language publications *Food & Package*, (2001) vol. 42, no. 10, pp 609-13; *Food & Package*, (2001) vol. 42, no. 11, pp 676-79; and *Food & Package*, (2001) vol. 42, no. 12, pp 732-35. Variations and modifications of existing foam-generating dispensers are especially useful herein, especially by modifying air piston: product piston volume ratio, mesh/net sizes, impinging angle, etc., as well as optimization of the sizes and dimensions of the cylinder, rod, dip tube, nozzle, etc.

While trigger-type foam-generating dispensers may be preferred for certain embodiments herein, a finger and/or palm-activated type pump (see, e.g., FIG. 1) is often preferred for aesthetic reasons. This is especially the case where the foam-generating kit is to be distinguished from the "harsh" image of typical hard-surface cleaners and similar heavy-duty products.

High Surfactant Composition

The high surfactant composition herein is typically selected from the group of a cleaning composition, a polishing composition, a moisturizing composition, and/or a coloring/dying composition, preferably a dishwashing composition, a hair care composition, a laundry composition, a body care composition, and/or a hard surface cleaning composition, and more preferably a hand dishwashing composition, a laundry composition, a skin care composition and/or a shampoo composition. Such a high surfactant composition therefore includes a surfactant system, and typically a solvent, and one or more optional ingredients known in the art of cleaning such as a dye, an enzyme, a perfume, a thickener, a pH controlling agent, a reducing or oxidizing bleach, an odor control agent, antioxidants and free radical inhibitors, and a mixture thereof.

The surfactant system herein typically includes an anionic surfactant, an amphoteric surfactant, a cationic surfactant, a nonionic surfactant, a zwitterionic surfactant, or a mixture thereof, preferably an alkyl sulfate, an alkoxy sulfate, an alkyl sulfonate, an alkoxy sulfonate, an alkyl aryl sulfonate, an amine oxide, a betaine or a derivative of aliphatic or heterocyclic secondary and ternary amine, a quaternary ammonium surfactant, an amine, a singly or multiply alkoxylated alcohol, an alkyl polyglycoside, a fatty acid amide surfactant, a $C_8$-$C_{20}$ ammonia amide, a monoethanolamide, a diethanolamide, an isopropanolamide, a polyhydroxy fatty acid amide and a mixture thereof. A mixture of anionic and nonionic surfactants is especially preferred. The surfactants useful herein may be further be branched and/or linear, substituted or unsubstituted, as desired. See also "Surface Active Agents and Detergents" (Vol. I and II by Schwartz, Perry and Berch).

The anionic surfactant useful herein includes water-soluble salts or acids of the formula $ROSO_3M$, wherein R preferably is a $C_6$-$C_{20}$ linear or branched hydrocarbyl, preferably an alkyl or hydroxyalkyl having a $C_{10}$-$C_{20}$ alkyl component, more preferably a $C_{10}$-$C_{14}$ alkyl or hydroxyalkyl, and M is H or a cation, e.g., an alkali metal cation or ammonium or substituted ammonium, but preferably sodium and/or potassium.

Other suitable anionic surfactants for use herein are water-soluble salts or acids of the formula $RO(A)_mSO_3M$ wherein R is an unsubstituted linear or branched $C_6$-$C_{20}$ alkyl or hydroxyalkyl group having a $C_{10}$-$C_{20}$ alkyl component, preferably a $C_{12}$-$C_{20}$ alkyl or hydroxyalkyl, more preferably $C_{12}$-$C_{14}$ alkyl or hydroxyalkyl, A is an ethoxy or propoxy unit, m is greater than zero, typically between about 0.5 and about 5, more preferably between about 0.5 and about 2, and M is H or a cation which can be, for example, a metal cation, ammonium or substituted-ammonium cation. Alkyl ethoxylated sulfates (abbreviated herein as $C_{X-Y}E_mS$, where X-Y represents the alkyl group chain length, and where m is the same as described above) as well as alkyl propoxylated sulfates are thus preferred herein. Exemplary surfactants are $C_{10}$-$C_{14}$ alkyl polyethoxylate (1.0) sulfate, $C_{10}$-$C_{14}$ polyethoxylate (1.0) sulfate, $C_{10}$-$C_{14}$ alkyl polyethoxylate (2.25) sulfate, $C_{10}$-$C_{14}$ polyethoxylate (2.25) sulfate, $C_{10}$-$C_{14}$ alkyl polyethoxylate (3.0) sulfate, $C_{10}$-$C_{14}$ polyethoxylate (3.0) sulfate, and $C_{10}$-$C_{14}$ alkyl polyethoxylate (4.0) sulfate, $C_{10}$-$C_{18}$ polyethoxylate (4.0) sulfate. In a preferred embodiment the anionic surfactant is a mixture of alkoxylated, preferably ethoxylated and non-alkoxylated sulfate surfactants. In such a preferred embodiment the preferred average degree of alkoxylation is from about 0.4 to about 0.8.

Other particularly suitable anionic surfactants for use herein are alkyl sulphonates and alkyl aryl sulphonates, including water-soluble salts or acids of the formula $RSO_3M$ wherein R is a $C_6$-$C_{20}$ linear or branched, saturated or unsaturated alkyl or aryl group, preferably a $C_{10}$-$C_{20}$ alkyl or aryl group and more preferably a $C_{10}$-$C_{14}$ alkyl or aryl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Also highly preferred are the linear and branched alkyl benzene sulphonates and more preferably linear alkyl benzene sulphonate.

In a further preferred embodiment, the carbon chain of the anionic surfactant comprises one or more alkyl, preferably $C_{1-4}$ alkyl, branching units. In such a case, the average percentage branching of the anionic surfactant is greater than about 30%, more preferably from about 35% to about 80% and most preferably from about 40% to about 60%, by weight of the anionic surfactant. Such average percentage of branching can be achieved by formulating the PME with one or more anionic surfactants all of which are preferably greater than about 30% branched, more preferably from about 35% to about 80% and most preferably from about 40% to about 60%. Alternatively and more preferably, the PME may comprise a combination of branched anionic surfactant and linear anionic surfactants such that on average the percentage of branching of the total anionic surfactant combination is greater than about 30%, more preferably from about 35% to about 80% and most preferably from about 40% to about 60%.

The amphoteric surfactant herein is a surfactant whose charge changes according to the pH of the PME, if applicable, or the ME, and is preferably selected from the various amine oxide surfactants. Amine oxides are semi-polar surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred are amine oxides of the formula:

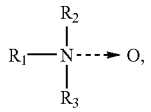

where $R_1$ is a $C_{10-14}$ alkyl and $R_2$ and $R_3$ are methyl or ethyl, and those described in U.S. Pat. No. 4,316,824 to Pancheri, granted on Feb. 23, 1982; U.S. Pat. No. 5,075,501 to Borland and Smith, granted on Dec. 24, 1991; and U.S. Pat. No. 5,071,594 to Borland and Smith, granted on Dec. 10, 1991.

Preferred amine oxide surfactants have the formula:

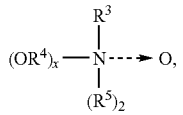

where $R^3$ is an alkyl, a hydroxyalkyl, an alkyl phenyl group or a mixture thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or a hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure. Preferred amine oxide surfactants include the $C_{10}$-$C_{18}$ alkyl dimethyl amine oxides and the $C_8$-$C_{12}$ alkoxy ethyl dihydroxy ethyl amine oxides.

Also suitable are amine oxides such as propyl amine oxides, represented by the formula:

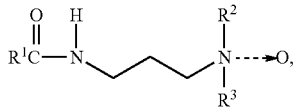

where $R^1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R^2$ and $R^3$ are each methyl, ethyl, propyl, isopropyl, 2-hydroxyethyl, 2-hydroxypropyl, or 3-hydroxypropyl and n is from 0 to about 10.

A further suitable species of amine oxide semi-polar surface active agents comprise compounds and mixtures of compounds having the formula:

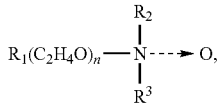

where $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10.

Other suitable, non-limiting examples of the amphoteric surfactant useful in the present invention includes amido propyl betaines and derivatives of aliphatic or heterocyclic secondary and ternary amines in which the aliphatic moiety can be straight chain, or branched and wherein one of the aliphatic substituents contains from about 8 to about 24 carbon atoms and at least one aliphatic substituent contains an anionic water-solubilizing group.

Further examples of suitable amphoteric surfactants are disclosed in "Surface Active Agents and Detergents" (Vol. I and II by Schwartz, Perry and Berch).

Cationic surfactants useful herein include quaternary ammonium salts having at least one $C_{10}$-$C_{14}$ alkyl chain, charge-balanced with an anion, such as chloride. Preferred cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of —$CH_2CH_2$—, —$CH_2CH(CH_3)$—, —$CH_3CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl, ring structures formed by joining the two $R^4$ groups, —$CH_2CHOHCHOHCOR^6CHOH$—$CH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, Mono-alkoxylated and di-alkoxylated ammonium salts may also be used herein, and are commonly available from suppliers such as Clariant Corporation, Charlotte N.C., USA and Akzo Nobel nv, Arnhem, the Netherlands.

Zwitterionic surfactants may also be useful herein and can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 Laughlin, et al., issued Dec. 30, 1975 at column 19, line 38 through column 22, line 48 for examples of zwitterionic surfactants. Zwitterionic surfactants particularly useful herein include commonly-available betaine surfactants, particularly lauryl amido propyl betaine, $C_{12}$-$C_{16}$ cocoamido propyl betaine, and a mixture thereof.

The PME herein also contains less than about 10%, preferably from about 0% to about 10%, more preferably from about 0% to about 5%, and even more preferably from about 0% to about 3% nonionic surfactant. Nonionic surfactants useful herein are generally disclosed in U.S. Pat. No. 3,929,678 to Laughlin, et al., issued Dec. 30, 1975, at column 13, line 14 through column 16, line 6. Other nonionic surfactants useful herein include the condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include TERGITOL® 15-S-9 (the condensation product of $C_{11}$-$C_{15}$ linear secondary alcohol with 9 moles ethylene oxide), TERGITOL® 24-L-6 NMW (the condensation product of $C_{12}$-$C_{14}$ primary alcohol with 6 moles ethylene oxide with a narrow molecular weight distribution), both marketed by Union Carbide Corporation; NEODOL® 45-9 (the condensation product of $C_{14}$-$C_{15}$ linear alcohol with 9 moles of ethylene oxide), NEODOL® 23-6.5 (the condensation product of $C_{12}$-$C_{13}$ linear alcohol with 6.5 moles of ethylene oxide), marketed by Shell Chemical Company, and KYRO® EOB (the condensation product of $C_{13}$-$C_{15}$ alcohol with 9 moles ethylene oxide), marketed by The Procter & Gamble Company, Cincinnati, Ohio, U.S.A. Other commercially available nonionic surfactants include DOBANOL 91-8® marketed by Shell Chemical Co. and GENAPOL UD-080® marketed by Hoechst. This category of nonionic surfactant is referred to generally as "alkyl ethoxylates."

Also useful herein is a nonionic surfactant selected from the group consisting of an alkyl polyglycoside surfactant, a fatty acid amide surfactant, a $C_8$-$C_{20}$ ammonia amide, a monoethanolamide, a diethanolamide, an isopropanolamide, and a mixture thereof. Such nonionic surfactants are known in the art, and are commercially-available. A particularly preferred nonionic surfactant useful herein is a $C_9$-$C_{12}$ alkyl polyglycoside from Cognis Corp. USA, Cincinnati, Ohio. Preferred alkylpolyglycosides have the formula:

$$R^2O(C_nH_{2n}O)_t(\text{glycosyl})_x,$$

wherein $R^2$ is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants include those having the formula:

$$R^6\overset{\overset{\displaystyle O}{\|}}{C}N(R^7)_2,$$

wherein $R^6$ is an alkyl group containing from about 7 to about 21 (preferably from about 9 to about 17) carbon atoms and each $R^7$ is selected from the group consisting of hydrogen, $C_1$-$C_4$ alkyl, $C_1$-$C_4$ hydroxyalkyl, and —$(C_2H_4O)_xH$ where x varies from about 1 to about 3.

Preferred amides are $C_8$-$C_{20}$ ammonia amides, monoethanolamides, diethanolamides, and isopropanolamides.

The composition herein may comprise up to about 20%, preferably from about 2% to about 10%, of a polyhydroxy fatty acid amide surfactant. If present, the polyhydroxy fatty acid amide surfactant component is typically of the formula:

$$R^2\overset{\overset{\displaystyle O}{\|}}{C}N\underset{\underset{\displaystyle R^1}{|}}{Z},$$

wherein $R^1$ is H, $C_1$-$C_4$ hydrocarbyl, 2-hydroxy ethyl, 2-hydroxy propyl, or a mixture thereof, preferably $C_1$-$C_4$ alkyl, more preferably $C_1$ or $C_2$ alkyl, even more preferably $C_1$ alkyl (i.e., methyl); and $R^2$ is a $C_5$-$C_{31}$ hydrocarbyl, preferably straight chain $C_7$-$C_{19}$ alkyl or alkenyl, more preferably straight chain $C_9$-$C_{17}$ alkyl or alkenyl, even more preferably straight chain $C_{11}$-$C_{15}$ alkyl or alkenyl, or a mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. $R^2$—C(O)—N< is preferably selected from cocamide, stearamide, oleamide, lauramide, myristamide, capricamide, palmitamide, tallowamide, and a mixture thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')$ $(CHOH)$—$CH_2OH$, and alkoxylated derivatives thereof, where n is an integer from 3 to 5, inclusive, and R' is H or a cyclic or aliphatic monosaccharide. Even more preferred are glycityls wherein n is 4, particularly —$CH_2$—$(CHOH)_4$—$CH_2OH$.

The high surfactant composition contains, by weight of the high surfactant composition, at least about 20% of a surfactant system; preferably from about 20% to about 100% of a surfactant system; more preferably from about 30% to about 99% of a surfactant system; even more preferably from about 35% to about 98% of a surfactant system; and yet even more preferably from about 40% to about 98% of a surfactant system.

The solvent useful herein is typically selected from the group consisting of water, alcohols, glycols, ether alcohols, and a mixture thereof, more preferably the group consisting of water, glycol, ethanol, glycol ethers, water, and a mixture thereof, even more preferably the group consisting of propylene carbonate, propylene glycol, tripropyleneglycol n-propyl ether, diethylene glycol n-butyl ether, water, and a mixture thereof. The solvent herein preferably has a solubility in water of at least about 12%, more preferably of at least about 50%, by weight of the solution.

Solvents which are capable of decreasing the product viscosity and/or imparting a shear-thinning or non-Newtonian rheology profile to the compositions may be present, but are not preferred herein, as such solvents are typically expensive, and do not provide significant non-shear related benefits. Accordingly, in a preferred embodiment, the high surfactant composition herein acts as a Newtonian Fluid throughout the relevant shear-range during use in the foam-generating dispenser.

Preferred solvents useful herein which impart a Newtonian behavior include mono, di and poly hydroxy alcohols, ethers, and mixtures thereof. Alkyl carbonates such as propylene carbonate are also preferred.

The enzyme useful herein includes a cellulase, a hemicellulase, a peroxidase, a protease, a gluco-amylase, an amylase, a lipase, a cutinase, a pectinase, a xylanase, a reductase, an oxidase, a phenoloxidase, a lipoxygenase, a ligninase, a pullulanase, a tannase, a pentosanase, a malanase, a β-glucanase, an arabinosidase and a mixture thereof. A preferred combination is a detergent composition having a cocktail of conventional applicable enzymes such as protease, amylase, lipase, cutinase and/or cellulase. An enzyme is typically present at from about 0.0001% to about 5% of active enzyme, by weight. Preferred proteolytic enzymes are selected from the group consisting of ALCALASE® ( (Novo Industri A/S), BPN', Protease A and Protease B (Genencor), and mixtures thereof. Protease B is more preferred. Preferred amylase enzymes include TERMAMYL®, DURAMYL® and the amylase enzymes described in WO 94/18314 A1 to Antrim, et al., published on Aug. 18, 1994 (assigned to Genencor International) and WO 94/02597 A1 to Svendsen and Bisgård-Frantzen, published on Feb. 3, 1994 (assigned to Novo Nordisk A/S). Further non-limiting examples of preferred enzymes are disclosed in WO 99/63034 A1 to Vinson, et al., published on Dec. 9, 1999.

A microemulsion or a protomicroemulsion composition, and especially a dishwashing composition typically also contains a low water-soluble oil having a solubility in water of less than about 5,000 ppm, preferably from about 0 parts per million (ppm) to about 1,500 ppm, by weight of the low water-soluble oil, and more preferably from about 1 part per trillion to about 100 ppm. Preferred low water-soluble oils useful herein include terpenes, isoparaffins, other oils having the above solubility, and a mixture thereof.

Figure 4:
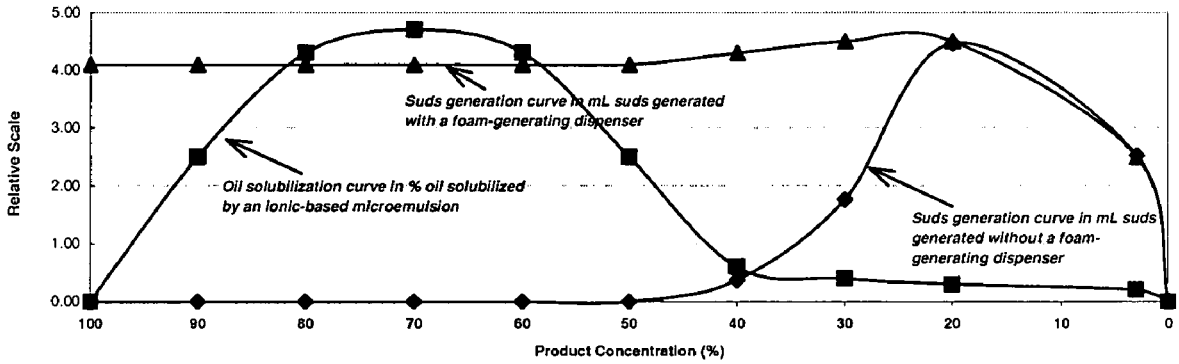
FIG. 4 is a graph of several suds generation curves.

In the absence of a foam-generating dispenser, the dishwashing composition here typically has an effective foaming dilution range of less than about 50%, preferably from about 0% to about 40%, and more preferably from about 0% to about 35% of the dilution range. However, in an embodiment of the invention herein, the dishwashing composition, when used with the foam-generating dispenser, has an effective foaming dilution range of at least about 50%, preferably from about 50% to about 100%, more preferably from about 75% to about 100%, and even more preferably from about 85% to about 100% of the dilution range. The effective foaming dilution range is calculated as follows: The suds generation curves of FIG. 4, are generated by testing various dilutions of a dishwashing composition via the suds cylinder test herein. Such a curve can be generated either with or without dispensing from a foam-generating dispenser into the cylinders. "Effective foam" is defined herein as foam which is at least half (50%) the maximum volume of foam generated for a given dishwashing composition according to the suds generation curve. Accordingly, in FIG. 4 for when the foam-generating dispenser is not employed, effective foam is formed from about 28% to about 2% product concentration, which translates into an effective foaming dilution range of 26% (i.e., 28%–2%). However, when the same dishwashing composition is employed with (i.e., dispensed from) the foam-generating dispenser, it can be seen that effective foam is generated from the point of dispensing (100% product concentration) until a product concentration of about 3% is reached. This is because the dishwashing kit generates foam at a substantially different dishwashing composition to water dilution than the dilution at which the maximum volume of foam is formed according to the suds cylinder test. Thus, the effective foaming dilution range when the dishwashing composition in FIG. 4 is dispensed from a foaming dispenser is 97% (i.e., 100%–3%).

The dishwashing composition useful herein has an oil solubilization curve which is generated by the oil solubilization test defined herein. "Effective oil solubilization" is defined herein as oil solubilization which is at least 20% of the maximum amount of oil solubilized for a given dishwashing composition according to the oil solubilization curve which is plotted as a function of product concentration (i.e., dilution). Accordingly, in FIG. 4, the maximum amount of oil solubilized is about 4.7 at a 70% product concentration, and thus the effective oil solubilization is an amount of at least about 0.94. The effective oil solubilization occurs from dilution ranges of about 96% to about 42%, which translates into an effective oil solubilization dilution range of about 54%.

As it can be seen in FIG. 4, there is virtually no overlap between the suds generation curve without a foam-generating dispenser and the effective oil solubilization dilution range. Similarly, it can be seen that absent a foam-generating dispenser, there is no overlap between the effective foaming dilution range (28% to 2%) and the effective oil solubilization dilution range (from 42% to 96%). In contrast, when a foam-generating dispenser is employed, the effective foaming dilution range (from 3% to 100%) completely (100%) overlaps the entire effective oil solubilization dilution range (from 42% to 96%). In a preferred embodiment, the effective foaming dilution range overlaps the effective oil solubilization dilution range, preferably the effective foaming dilution range overlaps the effective oil solubilization dilution range by at least about 10%, more preferably by from about 25% to about 100%, and even more preferably from about 50% to about 100%, especially in the case of a microemulsion or a protomicroemulsion. Furthermore, it is highly preferred that the effective foaming dilution range overlaps the point in the oil solubilization curve where the oil solubilization is at a maximum. Thus, the present invention encourages a user to use the product at a concentration/product dilution which more effectively solubilizes oil, and thereby optimizes cleaning.

The present invention has recognized that such a dishwashing composition, and especially microemulsion and protomicroemulsion dishwashing compositions require the container and foam-generating dispenser herein to achieve consumer-acceptable foaming at a dilution where the oil solubilization curve is more effective, and preferably maximized. Accordingly, it is preferred that when the dishwashing composition is employed with the container and foam-generating dispenser, an effective foam is generated at a dilution factor significantly different from the suds generation curve when the container and foam-generating dispenser is not employed.

Hand dishwashing compositions, cleaning compositions, protomicroemulsion compositions and microemulsion compositions useful in the present invention are known in the art, as described in, for example, WO 96/01305 A1 to Farnworth and Martin, published on Jan. 18, 1996; U.S. Pat. No. 5,854,187 to Blum, et al., issued on Dec. 29, 1998; U.S. Pat. No. 6,147,047 to Robbins, et al., issued on Nov. 14, 2000; WO 99/58631 A1 to Robbins, et al., published on Nov. 18, 1999; U.S. Pat. No. 4,511,488 to Matta, issued on Apr. 16, 1985; U.S. Pat. No. 5,075,026 to Loth, et al., issued on Dec. 24, 1991; U.S. Pat. No. 5,076,954 to Loth, et al., issued on Dec. 31, 1991; U.S. Pat. No. 5,082,584 to Loth, et al., issued on Jan. 21, 1992; U.S. Pat. No. 5,108,643 to Loth, et al., issued on Apr. 28, 1992; co-pending U.S. Patent Application No. 60/451064 (P&G Case # AA614FP) published as US 2004/0229767, to Ford, et al., entitled "Protomicroemulsion, Cleaning Implement Containing Same, And Method Of Use Therefor", filed on Feb. 28, 2003; co-pending U.S. Patent Application No. 60/472941 (P&G Case # AA614P2), published as US 2004/0229767 to Ford, et al., entitled "Protomicroemulsion, Cleaning Implement Containing Same, And Method Of Use Therefor", filed on May 23, 2003; co-pending U.S. patent application Ser. No. 10/788,123 (P&G Case # AA614M), published as US 2004/0229767 to Ford, et al., entitled "Protomicroemulsion, Cleaning Implement Containing Same, And Method Of Use Therefor", filed on Feb. 26, 2004; and co-pending U.S. patent application Ser. No. 10/788,121 (P&G Case # AA633M), published as US 2004/0229766 to Hutton and Foley, entitled "Protomicroennulsion, Cleaning Implement Containing Same, And Method Of Use Therefor", filed on Feb. 26, 2004. The dishwashing compositions noted in the above references or variations of the above compositions, are especially preferred for use in combination with the container and foam-generating dispenser described herein.

The high surfactant composition herein typically has a viscosity of at least about 0.05 Pa*s, preferably from about 0.05 Pa*s to about 10 Pa*s, more preferably from about 0.1 Pa*s to about 7 Pa*s, even more preferably from about 0.2 Pa*s to about 5 Pa*s, and yet even more preferably from about 0.3 Pa*s to about 4 Pa*s.

While the high surfactant composition is preferably sold within the container as a single item, this is not necessary, as refills, and separate components within the same kit are contemplated herein.

Shaped Applicator

It has further been discovered that a shaped applicator can surprisingly provide significantly improved results and ease of use as compared to a normal applicator. The shaped applicator is designed and sized to be easily held in the hand and is used to apply the foamed dishwashing composition to the surface to be cleaned, i.e., the dish. It has been found that if the foamed dishwashing composition is applied to a flat applicator, then the foamed dishwashing composition is quickly wiped onto the first dish contacted, but that little foamed dishwashing composition will remain on the flat applicator, for cleaning subsequent dishes. This makes the use of a foamed dishwashing composition both expensive, as composition mileage is significantly decreased, and tiresome, as new foamed dishwashing composition constantly needs to be applied to the flat applicator. In contrast, a shaped applicator which contains a receiving area, such as a protected indentation and/or a pocket, for the foamed dishwashing composition will more effectively hold and mete out the foamed dishwashing composition over time.

As the shaped applicator will often be used for scrubbing, it is preferred that at least one surface thereof contain an abrasive surface. The shaped applicator is typically selected from a porous material such as a natural or artificial sponge, a brush, a metal scouring device, a woven material, a nonwoven material, an abrasive material, a plastic material, a cloth material, a microfiber cleaning material, a polymeric material, a resin material, a rubber material, or a mixture thereof, preferably a natural or artificial sponge, a brush, a metal scouring device, an abrasive material, a foam rubber material, a functional absorbent material (FAM), a polyurethane foam, and a mixture thereof, and more preferably a natural or artificial sponge, a brush, an abrasive material, a foam rubber material, and a mixture thereof, with all types of open-celled structures being highly preferred. Such shaped applicators are available from a variety of commercial sources, such as Minnesota Mining and Manufacturing Company (3M), St. Paul, Minn., U.S.A. If the shaped applicator is formed from a relatively delicate material, or a material which is easily torn, then it is preferable that this material be covered, partially or completely, with a water-permeable, more robust material, such as a nonwoven material. Also useful are surfaces formed from plastic or polymeric materials such as available from, for example, Minnesota Mining and Manufacturing Company (3M), St. Paul, Minn., U.S.A., and found on, for example, Scotch-Brite™ General Purpose Scrubbing Pads.

Preferably, the FAM useful herein has an absorbent ability of more than about 20 g $H_2O$/g, more preferably, 40 g $H_2O$/g by weight of FAM. Such a preferred FAM is described in U.S. Pat. No. 5,260,345 to DesMarais, et al., issued on Nov. 9, 1993 or U.S. Pat. No. 5,889,893 to Dyer, et al., issued on May 4, 1999. Examples of a preferred polyurethane is described in U.S. Pat. No. 5,089,534 to Thoen, et al., issued on Feb. 18, 1992; U.S. Pat. No. 4,789,690 to Milovanovic-Lerik, et al., issued on Dec. 6, 1988; Japanese Patent Publication No. 10-182780 to Kao Corporation, published on Jul. 7, 1998; Japanese Patent Publication No. 9-30215 to Yokohama Gum, published on Feb. 4, 1997; Japanese Patent Publication No. 5-70544 to The Dow Chemical Company, published on Mar. 23, 1993; and Japanese Patent Publication No. 10-176073 to The Bridgestone Company, published on Jun. 30, 1998.

Preferably, the shaped applicator is not hard, but instead has at least one resilient portion, preferably a resilient portion which is covered by an abrasive surface. Such an optional resilient portion allows the user to vary the amount of contact, pressure, etc., between the scrubbing surface and the dish. The foamed dishwashing composition is thus preferably applied into or onto the shaped applicator directly from the foam-generating dispenser.

Figure 2:
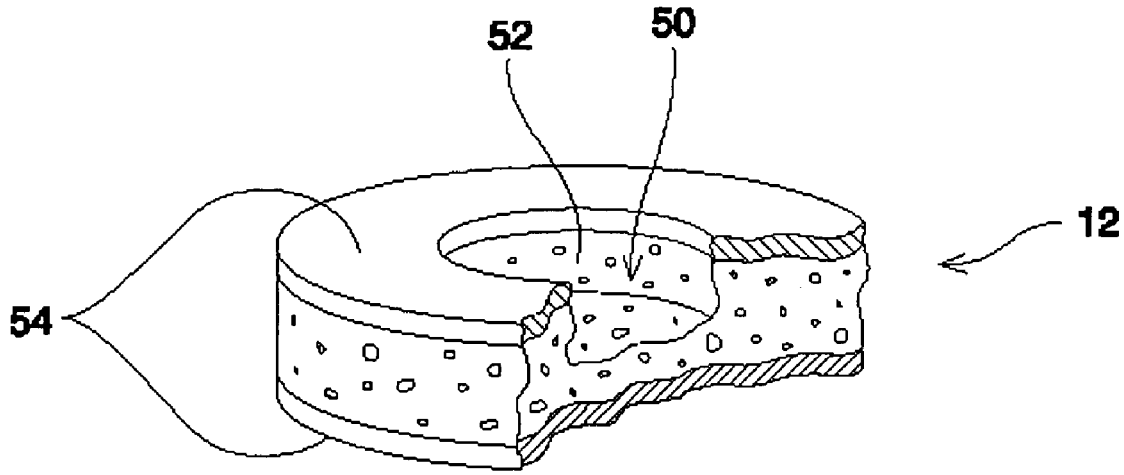
FIG. 2 is a top perspective, cut-away view of a preferred embodiment of the shaped applicator.

Turning to FIG. 2, which shows a top perspective, cut-away view of a preferred embodiment of the shaped applicator, 12, herein, a sponge-type shaped applicator, 12, contains a receiving area, 50, to which the foamed dishwashing composition is applied for use. The receiving area, 50, is therefore typically bounded by a wall, 52, which protects the foamed composition from being quickly rubbed off of the shaped applicator, 12. The receiving area is preferably a concave indentation in the shaped applicator which may be of any shape and design which keeps the foamed dishwashing composition in contact with the shaped applicator. In a preferred embodiment, the receiving area contains a relatively steep concave wall or other structure which effectively keeps the foamed detergent in the receiving area and dispenses it over time during typical use. Typically the receiving area holds from about 1 mL to about 200 mL, preferably from about 2 mL to about 150 mL, and more preferably from about 5 mL to about 100 mL of foamed dishwashing composition.

In FIG. 2, the shaped applicator, 12, further contains a plurality of abrasive surfaces, 54, for scrubbing a dish. It is highly preferred that at least one abrasive surface be provided on the shaped applicator.

Figure 3:
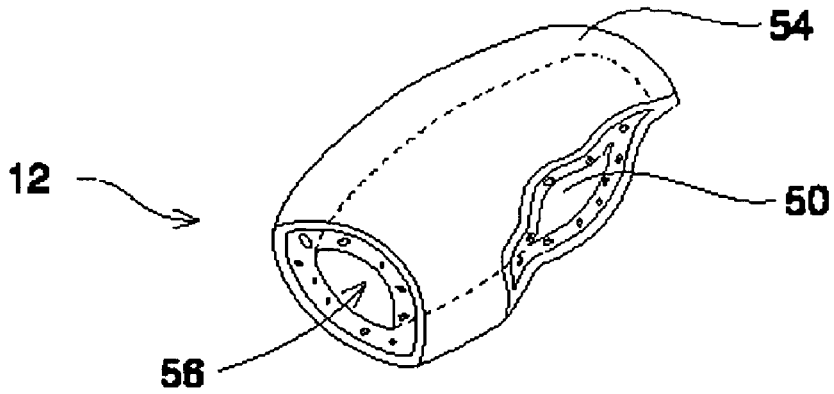
FIG. 3 is a perspective, cut-away view of a preferred embodiment of the shaped applicator.

FIG. 3 shows a perspective, cut-away view of a preferred embodiment of the shaped applicator, 12, which is formed as a sponge-type shaped applicator, 12, having a pocket-like receiving area, 50, whose internal dimensions are indicated by dashed lines. The foamed dishwashing composition is added to the receiving area, 50, via a mouth, 56, which may be permanently open, or may be closeable, as desired. An abrasive surface, 54, substantially covers the entire exterior of the shaped applicator, 12, to assist in removing stains from a dish.

Test Methods

The viscosity herein is measured on a Brookfield viscometer model # LVDVII+ at 20° C. The spindle used for these measurements is a S31 spindle with the appropriate speed to measure products of different viscosities; e.g., 12 rpm to measure products of viscosity greater than 1 Pa*s; 30 rpm to measure products with viscosities between 0.5 Pa*s-1 Pa*s; 60 rpm to measure products with viscosities less than 0.5 Pa*s.

To measure the solubilization capacity, 10.0 g of product (this amount includes water, if testing at a specific dilution) to be tested is placed in a 25 mL scintillation vial. To this, 0.1 g food grade canola oil dyed with 0.045% of Pylakrome RED-LX1903 (a mixture of SOLVENT RED 24 CAS# 85-83-6 and SOLVENT RED 26 CAS# 4477-79-6, available from Pylam Products, Tempe, Ariz., U.S.A.) dye is added, and the vial capped. The vial is shaken vigorously by hand for 5 seconds, and allowed to stand until it becomes clear via the ISO 7027 turbidity measuring procedure, or until 5 minutes has passed, whichever comes first. The ISO 7027 method measures turbidity at a wavelength of 880 nm with turbidity measuring equipment such as that available from Omega Engineering, Inc., Stamford, Conn., U.S.A. If the vial becomes clear, then more oil is added, in increments of 0.1 g, until the vial fails to become clear within the prescribed time. The % oil dissolution is recorded as the maximum amount of oil which was successfully solubilized (i.e., the vial is clear) by 10.0 g of product. Preferably, the dishwashing composition herein solubilizes at least about 1 g of dyed canola oil, more preferably at least about 3 g of dyed canola oil, and even more preferably at least about 4 g of dyed canola oil when tested at a 75% product concentration.

The sudsing profile can be measured by employing a suds cylinder tester (SCT), and using the data to plot a suds generation curve. The SCT has a set of 4 cylinders. Each cylinder is typically 30 cm long, and 10 cm in diameter. The cylinder walls are 0.5 cm thick, and the cylinder bottom is 1 cm thick. The SCT rotates a test solution in a closed cylinder, typically a plurality of clear plastic cylinders, at a rate of about 21 revolutions per minute, for 2 minutes, after which the suds height is measured. Soil may then be added to the test solution, agitated again, and the resulting suds height measured, again. Such a test may be used to simulate the initial sudsing profile of a composition, as well as its sudsing profile during use, as more soils are introduced from the surface being washed.

The sudsing profile test is as follows:

1. Prepare a set of clean, dry, calibrated cylinders, and water having a water hardness of 136.8 parts per million (2.1 grains per liter), and having a temperature of 25° C.
2. Add the appropriate amount of test composition to each cylinder and add water to make a total 500 mL of composition+water in each cylinder.
3. Seal the cylinders and place them in the SCT.
4. Turn on the SCT and rotate the cylinders for 2 minutes.
5. Within 1 minute, measure the height of the suds in centimeters.
6. The sudsing profile is the average level of suds, in cm, generated by the composition.

The compositions according to the invention preferably have a sudsing profile maxima of at least about 2 cm, more preferably at least about 3 cm, and even more preferably about 4 cm.

Foam to weight ratio is a measurement of the mL of foam generated per gram of product. Foam to weight ratio is measured as follows: a volumetric measuring device, such as a graduated cylinder is weighed to get a tare weight. Then, the product is dispensed, using the foam-generating dispenser, if appropriate, into a graduated cylinder a set number of strokes for non-continuous dispensing devices or for a set time period for continuous dispensing devices. 10 strokes for non-continuous devices (pumps, sprayers) or 10 seconds for continuous devices is the suggested duration. The dispensing rate in the test should be consistent with the dispensing rate during normal usage scenarios. For example, 120 strokes per minute for trigger sprayers, or 45 strokes per minute for palm pumps.

The volume of foam generated is measured in mL using the volumetric measuring device.

The volumetric measuring device containing the dispensed product is weighed in grams. The tare weight of the volumetric measuring device is subtracted from this weight. The result is the grams of the product dispensed. Finally, the foam to weight ratio in mL/g is calculated by dividing the volume of foam generated (in mL) by the weight product dispensed (in g).

The foam to weight ratio of mL/g is easily converted to mL foam per mL of product by multiplying by the density of the high surfactant composition.

Examples of the invention are set forth hereinafter by way of illustration and are not intended to be in any way limiting of the invention. The examples are not to be construed as limitations of the present invention since many variations thereof are possible without departing from its spirit and scope.

EXAMPLE 1

A foam-generating kit contains a 300 mL hollow plastic container filled with a microemulsion dishwashing composition, and an attached T1 series foamer from Airspray, similar to that shown in FIG. 1. The T1 foamer is modified to include a third mesh, as seen in FIG. 1, at 41, at the tip of the nozzle. A shaped applicator according to FIG. 3 is also included. When dispensed, the foamed dishwashing composition has a foam to weight ratio of about 3 mL/g, and the foam has a creamy, even look and feel. The foamed dishwashing composition is dispensed from the foaming dispenser into a pocket-type shaped applicator by sticking the nozzle of the foam-generating dispenser into the mouth of the shaped applicator, and pressing down on the activator. When used as described above, the dishwashing kit provides good mileage, and a foam which lasts throughout the normal use to clean dishes. However, if the foam-generating dispenser is not used (i.e., the dishwashing composition is merely poured out of the container), the effective foaming dilution range does not significantly overlap the effective oil solubilization dilution range.

EXAMPLE 2

Ionic-based microemulsions according to the following formulas A-G are provided, packaged with the foam-generating dispenser of Example 1. Formula F is a gel, while the other formulas are all liquids.

| | A | B | C | D | E | F | G |
|---|---|---|---|---|---|---|---|
| Sodium $C_{12}$ Alkyl Ethoxy$_{0.6}$ Sulfate | 35 | 40 | 35 | 35 | 28 | 30 | 26 |
| $C_{12-14}$ Alkyl Dimethyl Amine Oxide | 8.5 | 9.6 | 8.5 | 8.5 | 6.3 | 7.3 | 6 |
| $C_8$ Alcohol Ethoxylated Nonionic surfactant | 3.9 | 4.4 | 3.9 | 3.9 | 3 | 3.4 | 3 |
| Poly(dimethylamino-methacrylate) | 0.2 | 0.3 | 0.2 | 0.2 | 0.2 | 0.2 | 0.2 |
| 1,3-bis(methylamine)-cyclohexane | 0.6 | 0.7 | 0.6 | 0.6 | 0.5 | 0.6 | 0.6 |
| Enzyme (amylase/protease) | 0.1 | — | — | 0.1 | 0.1 | — | — |
| Organic | | | | | | | |
| Isoparaffin | 4 | 4 | — | — | — | 20 | — |
| Limonene | — | — | — | 6 | 10 | — | — |
| Terpineol | — | — | 8 | — | — | — | — |
| Solvent | | | | | | | |
| Ethanol | 10 | 6 | 2 | 10 | 12 | — | 8 |
| Propylene Glycol | — | — | 14 | — | — | — | — |
| tripropyleneglycol n-propyl ether | — | — | — | — | — | 10 | — |
| Monoethanolamide | — | — | — | — | — | 5 | — |
| Propylene Carbonate | — | — | — | — | 8 | — | — |
| Water | bal. | bal. | bal. | bal. | bal. | bal. | bal. |
| Thickeners | | | | | | | |
| Fumed Silica | — | — | — | — | — | 2.5 | — |
| Xanthan gum | — | — | — | — | — | 2.5 | — |

EXAMPLE 3

A foam-generating kit according to Example 1 is prepared, except that the T1 foamer is modified with a sponge at the tip, instead of a third mesh. The sponge is an artificial sponge which is cut into shape and is securely affixed immediately inside of the nozzle. The foam generated is creamy and aesthetically pleasing.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A foam-generating kit comprising:

A. a non-aerosol container comprising a foam-generating dispenser for generating a foam, wherein the foam-generating dispenser includes a gas imparting mechanism to form the foam from air via an air injection piston, foam-generating aperture, an impinging surface, a mesh or net, a pump, an additional mesh and/or sponge located slightly within, and/or at the tip of the nozzle of said container, and a sprayer; and B. a high surfactant dishwashing composition comprising, by weight of the high surfactant dishwashing composition, from 47.4% to about 99% of a surfactant system, said dishwashing composition comprising at least one of a microemulsion and a protomicroemulsion, wherein when employed with the high surfactant dishwashing composition, the foam-generating dispenser generates a foam having a foam to weight ratio of greater than about 2 mL/g.

2. The foam-generating kit according to claim 1, wherein said surfactant system comprises from about 54% to about 99% of the high surfactant dishwashing composition, by weight.

3. The foam-generating kit according to claim 1, wherein the foam-generating dispenser comprises at least three meshes, wherein the high surfactant dishwashing composition flows through the three meshes in series so as to generate the foam.

4. The foam-generating kit according to claim 1, wherein the high surfactant dishwashing composition is a Newtonian Fluid.

5. The foam-generating kit according to claim 1, wherein the high surfactant dishwashing composition further comprises an enzyme.

6. The foam-generating kit according to claim 1, further comprising a shaped applicator.

7. The foam-generating kit according to claim 1 wherein the high surfactant composition comprises non-visible droplets of oil.

8. The foam-generating kit of claim 1, wherein the non-aerosol container is a single compartment container.

9. A foam-generating kit according to claim 1 wherein said high surfactant dishwashing composition is in the form of a microemulsion.

10. A foam-generating kit according to claim 1 wherein said high surfactant dishwashing composition is in the form of a protomicroemulsion.

11. A foam-generating kit according to claim 7 wherein said non-visible droplets of oil have a maximum diameter of less than about 100 angstroms as measured by ISO method 7027.

12. The foam-generating kit according to claim 1 wherein the microemulsion or protomicroemulsion comprises a low water-soluble oil having a solubility in water of less than about 5,000 ppm.

13. The foam-generating kit according to claim 12 wherein the low water-soluble oil is selected from the group consisting of: terpenes, isoparaffins, and mixtures thereof.

* * * * *

UNITED STATES PATENT AND TRADEMARK OFFICE

CERTIFICATE OF CORRECTION

PATENT NO. : 7,651,992 B2
APPLICATION NO. : 10/787343
DATED : January 26, 2010
INVENTOR(S) : Culeron et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 362 days.

Signed and Sealed this

Fifth Day of October, 2010

David J. Kappos

David J. Kappos
*Director of the United States Patent and Trademark Office*